US009818359B2

(12) United States Patent
Xiao et al.

(10) Patent No.: US 9,818,359 B2
(45) Date of Patent: Nov. 14, 2017

(54) SCANNING-DRIVING CIRCUIT AND LIQUID CRYSTAL DISPLAY DEVICE HAVING THE SAME

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Juncheng Xiao, Guangdong (CN); Mang Zhao, Guangdong (CN)

(73) Assignees: Shenzhen China Star Optoelectronics Technology Co., Ltd, Shenzhen, Guangdong (CN); Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 208 days.

(21) Appl. No.: 14/889,272

(22) PCT Filed: Sep. 25, 2015

(86) PCT No.: PCT/CN2015/090672
§ 371 (c)(1),
(2) Date: Nov. 5, 2015

(87) PCT Pub. No.: WO2017/049569
PCT Pub. Date: Mar. 30, 2017

(65) Prior Publication Data
US 2017/0169783 A1 Jun. 15, 2017

(51) Int. Cl.
*G09G 3/36* (2006.01)

(52) U.S. Cl.
CPC ..... *G09G 3/3677* (2013.01); *G09G 3/3659* (2013.01); *G09G 2300/0426* (2013.01); *G09G 2310/08* (2013.01)

(58) Field of Classification Search
CPC ..... G09G 3/3677; G09G 3/3659; G09G 2300/0426; G09G 2310/08; G11C 7/1057; G11C 7/12; G11C 8/08
See application file for complete search history.

(56) References Cited

U.S. PATENT DOCUMENTS 8,406,372 B2 3/2013 Hus et al.
2002/0075729 A1* 6/2002 Choi ..... G11C 7/12 365/189.11

(Continued)

FOREIGN PATENT DOCUMENTS

CN 103915052 A 7/2014
CN 104485079 A 4/2015

(Continued)

*Primary Examiner* — Premal Patel
(74) *Attorney, Agent, or Firm* — Andrew C. Cheng

(57) ABSTRACT

A scanning-driving circuit and a liquid crystal display device are disclosed. The scanning-driving circuit has a forward-backward scanning module to output a forward and backward scanning-driving signals; a pull-up holding module connected to the forward-backward scanning module to receive a selecting signal of the forward-backward scanning module and to pull up a voltage level of a pull-down control signal node; an input module connected to the forward-backward scanning module and the pull-up holding module to receive a previous-stage clock signal and to charge a pull-up control signal node; a control module connected to the pull-up holding module to receive a present-stage clock signal and to control the pull-up holding module; an output module connected to the pull-up holding module and the control module to output a scanning-driving signal to a scanning line, and to transmit the scanning-driving signal to a pixel unit to ensure a stability of the scanning-driving circuit.

18 Claims, 5 Drawing Sheets

(56) References Cited

U.S. PATENT DOCUMENTS

| | | | | |
|---|---|---|---|---|
| 2006/0176758 | A1* | 8/2006 | Chun | G11C 8/08 365/230.06 |
| 2014/0204689 | A1* | 7/2014 | Kim | G11C 7/1057 365/189.14 |
| 2015/0317936 | A1 | 11/2015 | Yang | |
| 2016/0180788 | A1 | 6/2016 | Xiao | |
| 2016/0189586 | A1* | 6/2016 | Zou | G09G 3/3266 345/213 |
| 2016/0358564 | A1 | 12/2016 | Xiao et al. | |
| 2016/0358572 | A1 | 12/2016 | Xiao et al. | |

FOREIGN PATENT DOCUMENTS

| | | | |
|---|---|---|---|
| CN | 104537992 | A | 4/2015 |
| WO | 2014172965 | A1 | 10/2014 |

* cited by examiner

SCANNING-DRIVING CIRCUIT AND LIQUID CRYSTAL DISPLAY DEVICE HAVING THE SAME

BACKGROUND OF THE INVENTION

1. Field of the Invention

The present invention relates to a liquid crystal technology field, and more particularly to a scanning-driving circuit and a liquid crystal display device having the same.

2. Description of Related Art

A conventional liquid crystal display device adopts a GOA (Gate Driver On Array) scanning-driving circuit, which is formed on an array substrate by a conventional manufacturing process of a thin film transistor liquid crystal display array to implement a driving way of scanning the gate line by line. The conventional scanning-driving circuit is often failure in a condition of a worse element characterize, and does not proceed well a backward-scanning control. Those are going to affect a stability of the scanning-driving circuit.

SUMMARY OF THE INVENTION

The main technology problem solved by the present invention is to provide a scanning-driving circuit and a liquid crystal display device having the same to ensure an operation stability of the scanning-driving circuit.

In order to solve the above technology problem, a technology solution adopted by the present invention is: a scanning-driving circuit comprising: a forward-backward scanning module to output a forward scanning-driving signal and a backward scanning-driving signal to drive the scanning-driving circuit, a pull-up holding module connected to the forward-backward scanning module to receive a selecting signal outputted from the forward-backward scanning module and to pull up a pull-down control signal node according to the received selecting signal, an input module connected to the forward-backward scanning module and the pull-up holding module to receive a previous-stage clock signal and to charge a pull-up control signal node according to the received previous-stage clock signal, a control module connected to the pull-up holding module to receive a present-stage clock signal and to control the pull-up holding module according the received the present-stage clock signal, an output module connected to the pull-up holding module and the control module to output a scanning-driving signal to a scanning line, and the scanning line transmitting the scanning-driving signal to a pixel unit.

The forward-backward scanning module comprises a controllable switch, a second controllable switch, a third controllable switch and a fourth controllable switch. A control terminal of the first controllable switch is connected to a first scanning-controlling voltage, an input terminal of the first controllable switch is connected to a next-stage scanning signal, and an output terminal of the first controllable switch is connected to the input module and pull-up holding module. A control terminal of the second controllable switch is connected to a second scanning-controlling voltage, an input terminal of the second controllable switch is connected to a previous-stage scanning signal, and an output terminal of the second controllable switch is connected to the output terminal of the first controllable switch. A control terminal of the third controllable switch is connected to the first scanning-controlling voltage, an input terminal of the third controllable switch is connected to a third next-stage clock signal, and an output terminal of the third controllable switch is connected to the pull-up holding module. A control terminal of the fourth controllable switch is connected to the second scanning-controlling voltage, an input terminal of the fourth controllable switch is connected to a first next-stage clock signal, and an output terminal of the fourth controllable switch is connected to the output terminal of the third controllable switch.

The input module comprises a fifth controllable switch. A control terminal of the fifth controllable switch is connected to a second next-stage clock signal, an input terminal of the fifth controllable switch is connected to the output terminal of the first controllable switch, and an output terminal of the fifth controllable switch is connected to the pull-up holding module and the control module.

The pull-up holding module comprises a sixth controllable switch, a seventh controllable switch, an eighth controllable switch, a ninth controllable switch and a first capacitor. An output terminal of the sixth controllable switch is connected to the output terminal of the fifth controllable switch, and a control terminal of the sixth controllable switch is connected to a control terminal of the ninth controllable switch. Input terminals of the sixth, seventh and ninth controllable switches are connected to a turn-on voltage terminal. A control terminal of the seventh controllable switch is connected to the control module, an output terminal of the seventh controllable switch is connected to the control terminals of the sixth and ninth controllable switches. An output terminal of the ninth controllable switch is connected to a scanning line and the output module. One terminal of the first capacitor is connected to the input terminal of the ninth controllable switch and the other terminal of the first capacitor is connected to the control terminal of the ninth controllable switch. A control terminal of the eighth controllable switch is connected to the output terminal of the third controllable switch, an input terminal of the eighth controllable switch is connected to a turn-off voltage terminal and an output terminal of the eighth controllable switch is connected to the output terminal of the seventh controllable switch.

The scanning-driving circuit further comprises a voltage regulation module to stabilize voltage and to prevent the pull-up holding module from leaking electricity. Thus, the voltage regulation module comprises a tenth controllable switch. A control terminal of the tenth controllable switch is connected to the input terminal of the eighth controllable switch and the turn-off voltage terminal, an input terminal of the tenth controllable switch is connected to the input terminal of the fifth controllable switch and the control module, and an output terminal of the tenth controllable switch is connected to the output module.

The output module comprises a eleventh controllable switch and a second capacitor. A control terminal of the eleventh controllable switch is connected to the output terminal of the tenth controllable switch, an input terminal of the seventh controllable switch is connected to a present-stage clock signal, and an output terminal of the seventh controllable switch is connected to the output terminal of the ninth controllable switch and the scanning line. One terminal of the second capacitor is connected to the control terminal of the eleventh controllable switch and the other terminal of the second capacitor is connected to the output terminal of the eleventh controllable switch.

The scanning-driving circuit further comprises a pull-up auxiliary module to prevent the input module from leaking electricity during charging the pull-up control signal node of the output module. The pull-up auxiliary module comprises a twelfth controllable switch. A control terminal of the twelfth controllable switch is connected to the output terminal of the first controllable switch, an input terminal of the twelfth controllable switch is connected to the turn-on voltage terminal, and an output terminal of the twelfth controllable switch is connected to the control terminal of the sixth controllable switch.

The control module comprises a thirteen controllable switch. A control terminal of the thirteen controllable switch is connected to the present-stage clock signal and input terminal of the eleventh controllable switch, an input terminal of the thirteen controllable switch is connected to the control terminal of the seventh controllable switch, and an output terminal of the thirteen controllable switch is connected to the input terminal of the tenth controllable switch and the output terminal of the fifth controllable switch.

The first to thirteen controllable switches are PMOS thin film transistors or NMOS thin film transistors.

In order to solve the above technology problem, another technology solution adopted by the present invention is: a liquid crystal display device comprising any one of the scanning-driving circuits mentioned above.

The beneficial effect of the present invention is: to distinguish the conventional technology, the liquid crystal display device of the present invention controls the pull-up holding module by the control module and avoids that an appearance of a competitive balance of the controllable switches during the control causes the scanning-driving circuit to be failed. And the liquid crystal display device pulls up the voltage level of the pull-up control signal node according to a signal selected by the forward-backward scanning module and to avoid that the scanning-driving circuit does not work normally during a backward scanning period, and thereby ensures the stability of the scanning-driving circuit.

DETAILED DESCRIPTION OF THE PREFERRED EMBODIMENTS

Figure 1:
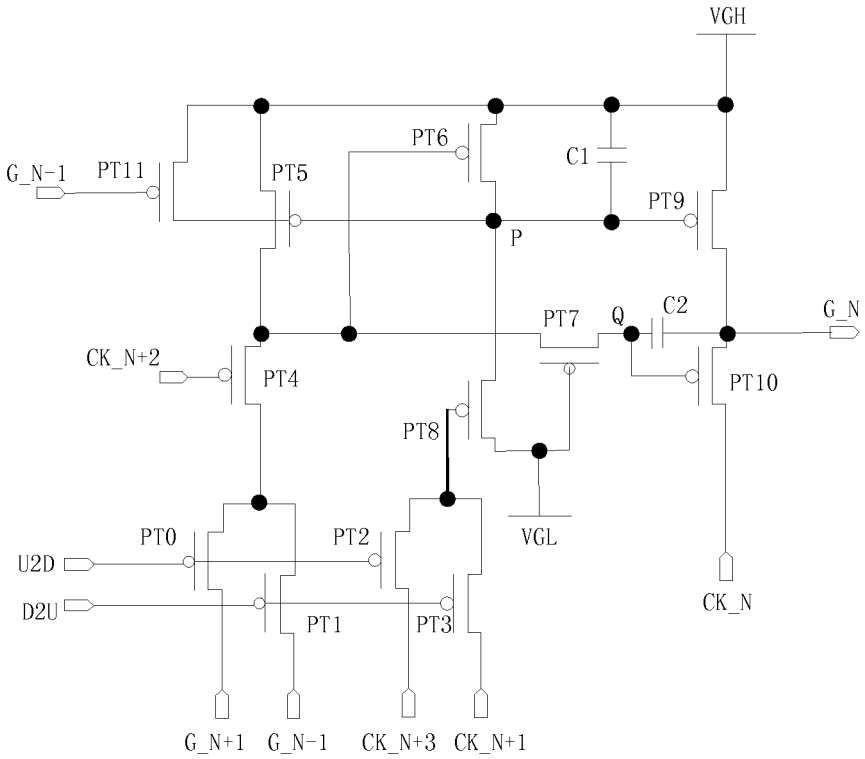
FIG. 1 (PRIOR ART)
FIG. 1 is a schematic structure diagram of a scanning-driving circuit of a conventional technology.
Figure 2:
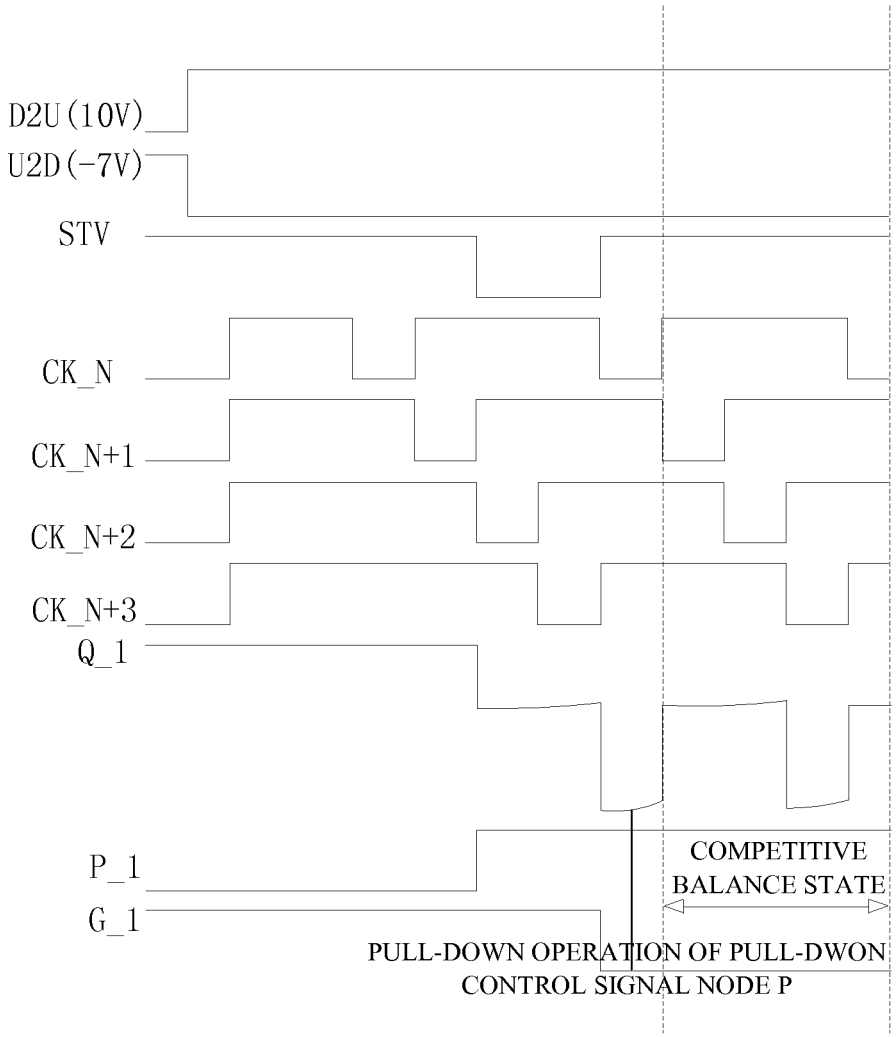
FIG. 2 (PRIOR ART)
FIG. 2 is a waveform diagram of a scanning-driving circuit of a conventional technology.

With reference FIG. 1 and FIG. 2, a conventional scanning-driving circuit can work normally at a better circumstance. However, when the conventional scanning-driving circuit works at a very adverse circumstance, a gate voltage of a thin film transistor PT8 is lower than a gate voltage of a thin film transistor PT6. It is going to cause that a competition between a source leakage current the thin film transistor PT8 formed by the gate-source voltage of the thin film transistor PT8 and a source leakage current the thin film transistor PT6 formed by the gate-source voltage of the thin film transistor PT6 achieves a dynamic balance, and a voltage of the pull-down control signal node P does not keep a low constant voltage level at non-working time so that the scanning-driving circuit may be failed. At the same time, FIG. 1 illustrates the scanning-driving circuit controlling the pull-down control signal node P by the previous-stage scanning signal G_N−1 only and a backward scanning circuit does not work normally accordingly. With further reference to FIG. 2, a waveform diagram represents that element characterizes of the scanning-driving circuit become worse. In FIG. 2, since the competition between the thin film transistors PT6 and PT8, a dynamic balance is occurred between a pull-down operation of the pull-down control signal node P and a pull-up operation of the pull-up control signal node Q. Therefore, an appearance is occurred and is that a voltage of the pull-up control signal node Q keeps at a low voltage level and a voltage of the pull-down control signal P keeps at a high voltage level, and thereby the scanning-driving circuit is failure.

Figure 3:
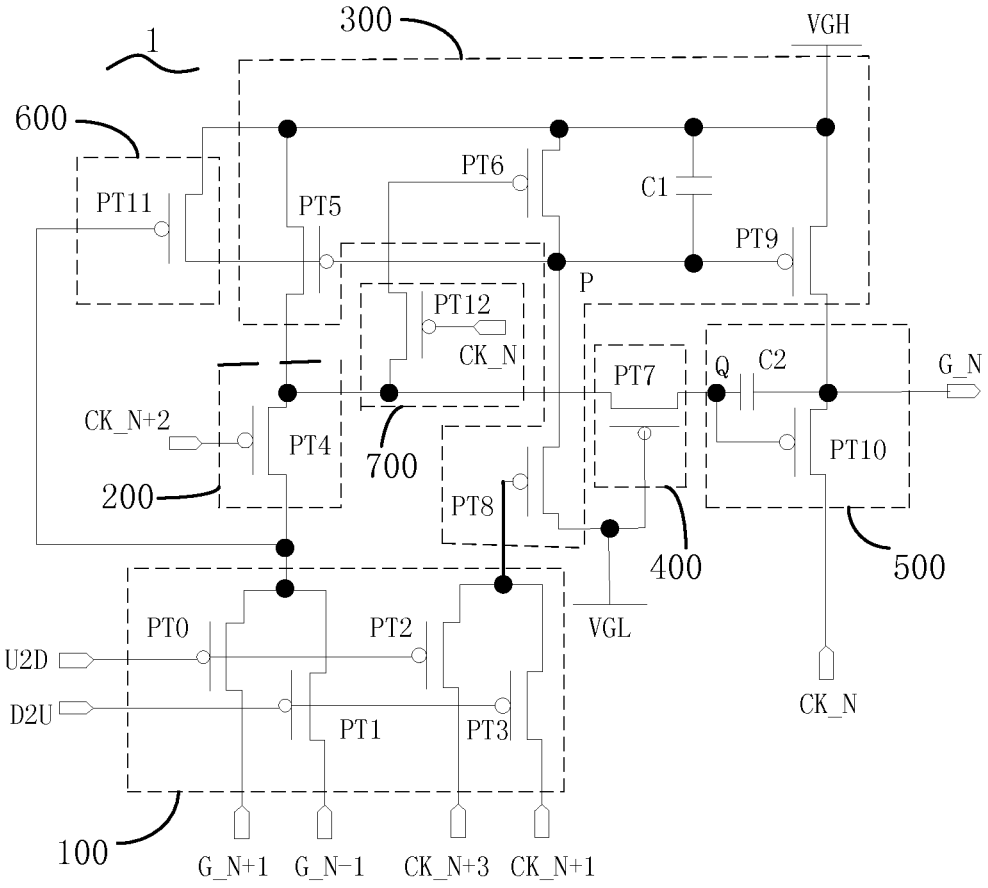
FIG. 3 is a schematic structure diagram of a scanning-driving circuit of a first embodiment of the present invention.

With reference to FIG. 3, it is a schematic structure diagram of a scanning-driving circuit of a first embodiment of the present invention. As shown in FIG. 3, the scanning-driving circuit 1 of the first embodiment has a forward-backward scanning module 100 to output a forward scanning-driving signal and a backward scanning-driving signal and backward scanning-driving signal to drive the scanning-driving circuit 1, a pull-up holding module 300 connected to the forward-backward scanning module 100 to receive a selecting signal outputted from the forward-backward scanning module 100 and to pull up a voltage level of a pull-down control signal node P according to the received selecting signal, an input module 200 connected to the forward-backward scanning module 100 and the pull-up holding module 300 to receive a previous-stage clock signal CK_K+2 and to charge a pull-up control signal node Q according to the received previous-stage clock signal CK_K+2, a control module 700 connected to the pull-up holding module 300 to receive a present-stage clock signal CK_N and to control the pull-up holding module 300 according the received the present-stage clock signal CK_N, an output module 500 connected to the pull-up holding module 300 and the control module 700 to output a scanning-driving signal G_N to a scanning line, and the scanning line transmitting the scanning-driving signal to a pixel unit.

The forward-backward scanning module 100 has a controllable switch PT0, a second controllable switch PT1, a third controllable switch PT2 and a fourth controllable switch PT3. A control terminal of the first controllable switch PT0 is connected to a first scanning-controlling voltage U2D, an input terminal of the first controllable switch PT0 is connected to a next-stage scanning signal G_N+1, and an output terminal of the first controllable switch PT0 is connected to the input module 200 and pull-up holding module 300. A control terminal of the second controllable switch PT1 is connected to a second scanning-controlling voltage D2U, an input terminal of the second controllable switch PT1 is connected to a previous-stage scanning signal G_N−1, and an output terminal of the second controllable switch PT1 is connected to the output terminal of the first controllable switch PT0. A control terminal of the third controllable switch PT2 is connected to the first scanning-controlling voltage U2D, an input terminal of the third controllable switch PT2 is connected to a third next-stage clock signal CK_N+3, and an output terminal of the third controllable switch PT2 is connected to the pull-up holding module 300. A control terminal of the fourth controllable switch PT3 is connected to the second scanning-controlling voltage D2U, an input terminal of the fourth controllable switch PT3 is connected to a first next-stage clock signal CK_N+1, and an output terminal of the fourth controllable switch PT3 is connected to the output terminal of the third controllable switch PT2. When the first scanning-controlling voltage U2D is high voltage level and the second scanning-controlling voltage D2U is low voltage level, the scanning-driving circuit 1 works at a forward scanning status. When the first scanning-controlling voltage U2D is low voltage level and the second scanning-controlling voltage D2U is high voltage level, the scanning-driving circuit 1 works at a backward scanning status.

The input module 200 has a fifth controllable switch PT4. A control terminal of the fifth controllable switch PT4 is connected to a second next-stage clock signal CK_N+2, an input terminal of the fifth controllable switch PT4 is connected to the output terminal of the first controllable switch PT0, and an output terminal of the fifth controllable switch PT4 is connected to the pull-up holding module 300 and the control module 700.

The pull-up holding module 300 has a sixth controllable switch PT5, a seventh controllable switch PT6, an eighth controllable switch PT8, a ninth controllable switch PT9 and a first capacitor C1. An output terminal of the sixth controllable switch PT5 is connected to the output terminal of the fifth controllable switch PT4, and a control terminal of the sixth controllable switch PT5 is connected to a control terminal of the ninth controllable switch PT9. Input terminals of the sixth, seventh and ninth controllable switches PT5, PT6 and PT9 are connected to a turn-on voltage terminal VGH. A control terminal of the seventh controllable switch PT6 is connected to the control module 700, an output terminal of the seventh controllable switch PT6 is connected to the control terminals of the sixth and ninth controllable switches PT5 and PT9. An output terminal of the ninth controllable switch PT9 is connected to a scanning line G_N and the output module 500. One terminal of the first capacitor C1 is connected to the input terminal of the ninth controllable switch PT9 and the other terminal of the first capacitor is connected to the control terminal of the ninth controllable switch PT9. A control terminal of the eighth controllable switch PT8 is connected to the output terminal of the third controllable switch PT2, an input terminal of the eighth controllable switch PT8 is connected to a turn-off voltage terminal VGL and an output terminal of the eighth controllable switch PT8 is connected to the output terminal of the seventh controllable switch PT6.

The scanning-driving circuit 1 further has a voltage regulation module 400 to stabilize voltage and to prevent the pull-up holding module 300 from leaking electricity. Thus, the voltage regulation module 400 has a tenth controllable switch PT7. A control terminal of the tenth controllable switch PT7 is connected to the input terminal of the eighth controllable switch PT8 and the turn-off voltage terminal VGL, an input terminal of the tenth controllable switch PT7 is connected to the input terminal of the fifth controllable switch PT4 and the control module 700, and an output terminal of the tenth controllable switch PT7 is connected to the output module 500.

The output module 500 comprises a eleventh controllable switch PT10 and a second capacitor C2. A control terminal of the eleventh controllable switch PT10 is connected to the output terminal of the tenth controllable switch PT7, an input terminal of the seventh controllable switch PT10 is connected to a present-stage clock signal CK_N, and an output terminal of the seventh controllable switch PT10 is connected to the output terminal of the ninth controllable switch PT9 and the scanning line G_N. One terminal of the second capacitor C2 is connected to the control terminal of the eleventh controllable switch PT10 and the other terminal of the second capacitor C2 is connected to the output terminal of the eleventh controllable switch TP10.

The scanning-driving circuit 1 further has a pull-up auxiliary module 600 to prevent an input module 200 from leaking electricity during charging the pull-up control signal node Q of the output module 500. The pull-up auxiliary module 600 has a twelfth controllable switch PT11. A control terminal of the twelfth controllable switch PT11 is connected to the output terminal of the first controllable switch PT0, an input terminal of the twelfth controllable switch PT11 is connected to the turn-on voltage terminal VGH, and an output terminal of the twelfth controllable switch PT11 is connected to the control terminal of the sixth controllable switch PT5.

The control module 700 has a thirteen controllable switch PT12. A control terminal of the thirteen controllable switch PT12 is connected to the present-stage clock signal CK_N and the input terminal of the eleventh controllable switch PT10, an input terminal of the thirteen controllable switch PT12 is connected to the control terminal of the seventh controllable switch PT6, and an output terminal of the thirteen controllable switch PT12 is connected to the input terminal of the tenth controllable switch PT7 and the output terminal of the fifth controllable switch TP4.

The scanning-driving circuit 1 controls the pull-up holding module 300 by the control module 700 and the present-stage clock signal CK_N. During a period of the present-stage clock signal CK_N, the thirteen controllable switch PT12 turns on and the pull-up control signal node Q controls the seventh controllable switch to stabilize the voltage of the pull-down control signal node P at the high voltage level and to prevent the output scanning signal G_N from being affected by an electric leakage of the pull-down control signal node P. After the present-stage scanning signal G_N is outputted completely, a voltage of the present-stage clock signal CK-N becomes a high voltage level, the thirteen controllable switch PT12 turns off, and then a pull-down control of the pull-down control signal node P is proceeded. Since the thirteen controllable switch PT12 turns off, an impedance state of the control terminal of the seventh controllable switch PT6 is high so that a competition balance between the seventh and eighth controllable switches PT6 and PT8 is effectively prevented. When a voltage of the next-stage signal CK_N+1 is low voltage level, a source leakage current of the eighth controllable switch PT8 is greater than a source leakage current of the seventh controllable switch PT6 and thereby a voltage of the pull-down control signal P can be pulled-down normally. Accordingly, the scanning-driving circuit 1 works normally. In the first embodiment, the first to thirteen controllable switches PT0-PT12 are PMOS thin film transistors.

In the first embodiment, the scanning-driving circuit 1 does not directly use the previous-stage scanning signal G_N−1 to proceed a pull-up control for the pull-down control signal P and thereby an abnormal work of the scanning-driving circuit 1 is prevented during a backward scanning period.

Figure 4:
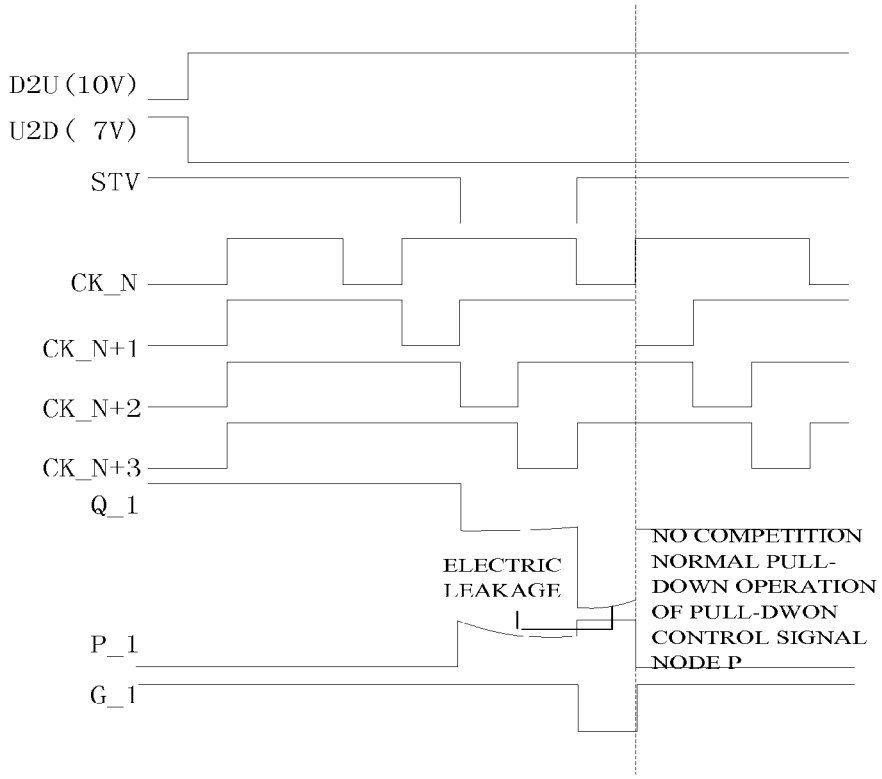
FIG. 4 is a waveform diagram of the scanning-driving circuit of the first embodiment of the present invention.

With further reference FIG. 4, it is a waveform diagram of the scanning-driving circuit 1 of the first embodiment of the present invention. In the preferred embodiment, the scanning-driving circuit 1 can provide a good pull-up and pull-down controls of the pull-down control signal node P and an appearance of the competition balance between the controllable switches is not showed up. With reference FIG. 4, assuming that the pull-down control signal has an appearance of the electric leakage, since the thirteen controllable switch PT12 turns off during an operation period of the pull-up control signal node Q, the voltage of the pull-down control signal node P cannot pull up to a stable high voltage level, electric charges are leaking out from of the first capacitor C1. However, since the voltage of the pull-up control signal node Q keeps at the low voltage level, the scanning-driving circuit 1 works normally. During a period of the scanning signal G_N, the thirteen controllable switch PT12 turns on, the voltage of the pull-down control signal P is pulled up to the stable high voltage level by the pull-up control signal Q, and the stability of the output scanning signal is maintained. After the output scanning signal is output completely, the thirteen controllable switch PT12 turns off, so that the impedance state of the control terminal of the seventh controllable switch PT6 is high and a normal pull-down operation of the pull-down control signal node P is not affected.

Figure 5:
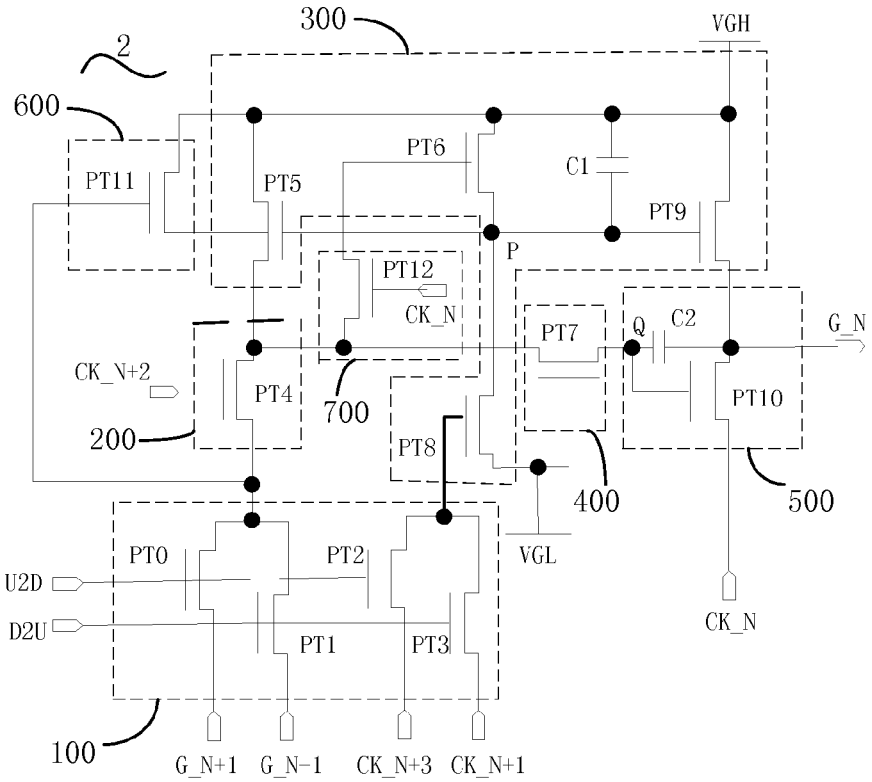
FIG. 5 is a schematic structure diagram of a scanning-driving circuit of a second embodiment of the present invention.

With reference to FIG. 5, it is a schematic structure diagram of a scanning-driving circuit 2 of a second embodiment of the present invention. The difference between the scanning-driving circuit 2 of the second embodiment and the scanning-driving circuit 1 of the first embodiment is that: the first to thirteen controllable switches are NMOS thin film transistors.

Figure 6:
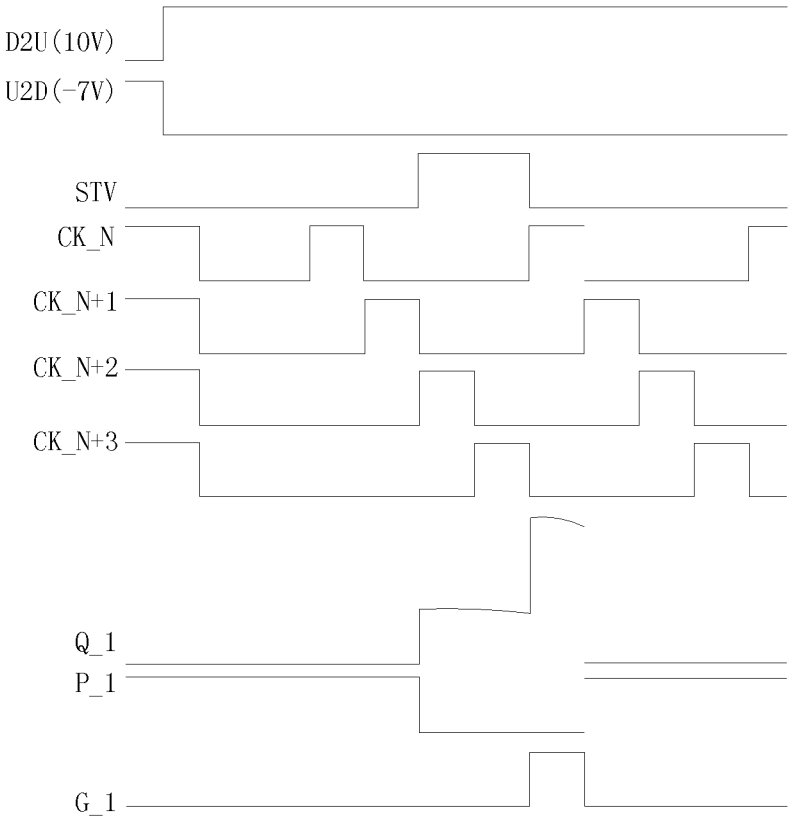
FIG. 6 is a waveform diagram of the scanning-driving circuit of the second embodiment of the present invention.

With further reference to FIG. 6, it is a waveform diagram of the scanning-driving circuit 2 of the second embodiment of the present invention. As shown in FIG. 6, the scanning-driving circuit 2 of the second embodiment has a good functionality the same as that of scanning-driving circuit 1 of the first embodiment and thereby the stable pull-up and pull-down controls of the pull-down control signal node P is implemented.

Figure 7:
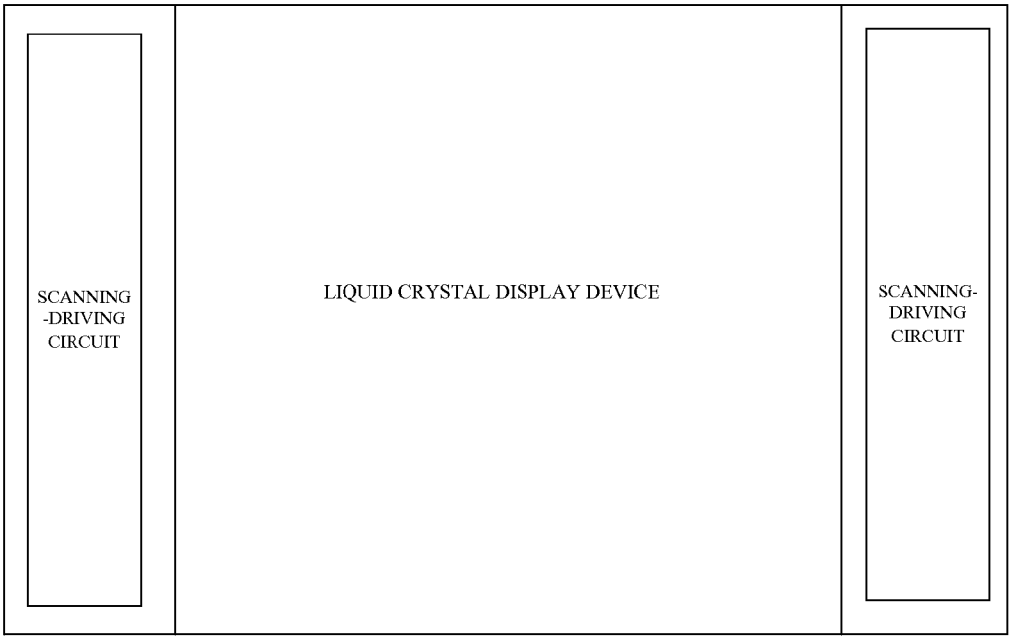
FIG. 7 is a schematic structure diagram of a liquid crystal display device of the present invention.

With reference to FIG. 7, it is a schematic structure diagram of a liquid crystal display device of the present invention. The liquid crystal display device has the scanning-driving circuit 1 or the scanning-driving circuit 2 mentioned above. The scanning-driving circuit 1 or 2 is mounted on two ends of the liquid crystal display device. The scanning-driving circuit 1 or 2 is any one of the scanning-driving circuit of the present invention.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A scanning-driving circuit, wherein the scanning-driving circuit comprises:

a forward-backward scanning module to output a forward scanning-driving signal and a backward scanning-driving signal to drive the scanning-driving circuit;

a pull-up holding module connected to the forward-backward scanning module to receive a selecting signal outputted from the forward-backward scanning module and to pull up a voltage level of a pull-down control signal node according to the received selecting signal;

an input module connected to the forward-backward scanning module and the pull-up holding module to receive a previous-stage clock signal and to charge a pull-up control signal node according to the received previous-stage clock signal;

a control module connected to the pull-up holding module to receive a present-stage clock signal and to control the pull-up holding module according the received the present-stage clock signal;

an output module connected to the pull-up holding module and the control module to output a scanning-driving signal to a scanning line; and the scanning line transmitting the scanning-driving signal to a pixel unit;

wherein the scanning-driving circuit further comprises a pull-up auxiliary module to prevent the input module from leaking electricity during charging the pull-up control signal node of the output module.

2. The scanning-driving circuit according to claim 1, wherein the forward-backward scanning module comprises a first controllable switch, a second controllable switch, a third controllable switch and a fourth controllable switch; a control terminal of the first controllable switch is connected to a first scanning-controlling voltage; an input terminal of the first controllable switch is connected to a next-stage scanning signal; an output terminal of the first controllable switch is connected to the input module and pull-up holding module; a control terminal of the second controllable switch is connected to a second scanning-controlling voltage; an input terminal of the second controllable switch is connected to a previous-stage scanning signal; an output terminal of the second controllable switch is connected to the output terminal of the first controllable switch; a control terminal of the third controllable switch is connected to the first scanning-controlling voltage; an input terminal of the third controllable switch is connected to a third next-stage clock signal; an output terminal of the third controllable switch is connected to the pull-up holding module; a control terminal of the fourth controllable switch is connected to the second scanning-controlling voltage; an input terminal of the fourth controllable switch is connected to a first next-stage clock signal; and an output terminal of the fourth controllable switch is connected to the output terminal of the third controllable switch.

3. The scanning-driving circuit according to claim 2, wherein the input module comprises a fifth controllable switch; a control terminal of the fifth controllable switch is connected to a second next-stage clock signal; an input terminal of the fifth controllable switch is connected to the output terminal of the first controllable switch, and an output terminal of the fifth controllable switch is connected to the pull-up holding module and the control module.

4. The scanning-driving circuit according to claim 3, wherein the pull-up holding module comprises a sixth controllable switch, a seventh controllable switch, an eighth controllable switch, a ninth controllable switch and a first capacitor; an output terminal of the sixth controllable switch is connected to the output terminal of the fifth controllable switch; a control terminal of the sixth controllable switch is connected to a control terminal of the ninth controllable switch; an input terminals of the sixth, seventh and ninth controllable switches, and are connected to a turn-on voltage terminal; a control terminal of the seventh controllable switch is connected to the control module, an output terminal of the seventh controllable switch is connected to the control terminals of the sixth and ninth controllable switches; an output terminal of the ninth controllable switch is connected to a scanning line and the output module; one terminal of the first capacitor is connected to the input terminal of the ninth controllable switch; the other terminal of the first capacitor is connected to the control terminal of the ninth controllable switch; a control terminal of the eighth controllable switch is connected to the output terminal of the third controllable switch, an input terminal of the eighth controllable switch is connected to a turn-off voltage terminal; and an output terminal of the eighth controllable switch is connected to the output terminal of the seventh controllable switch.

5. The scanning-driving circuit according to claim 4, wherein the scanning-driving circuit further comprises a voltage regulation module to stabilize voltage and to prevent the pull-up holding module from leaking electricity; the voltage regulation module comprises a tenth controllable switch; a control terminal of the tenth controllable switch is connected to the input terminal of the eighth controllable switch and the turn-off voltage terminal; an input terminal of the tenth controllable switch is connected to the input terminal of the fifth controllable switch and the control module; and an output terminal of the tenth controllable switch is connected to the output module.

6. The scanning-driving circuit according to claim 5, wherein the output module comprises a eleventh controllable switch and a second capacitor; a control terminal of the eleventh controllable switch is connected to the output terminal of the tenth controllable switch; an input terminal of the seventh controllable switch is connected to a present-stage clock signal; an output terminal of the seventh controllable switch is connected to the output terminal of the ninth controllable switch and the scanning line; one terminal of the second capacitor is connected to the control terminal of the eleventh controllable switch; and the other terminal of the second capacitor is connected to the output terminal of the eleventh controllable switch.

7. The scanning-driving circuit according to claim 6, wherein the control module comprises a thirteen controllable switch; a control terminal of the thirteen controllable switch is connected to the present-stage clock signal and the input terminal of the eleventh controllable switch; an input terminal of the thirteen controllable switch is connected to the control terminal of the seventh controllable switch; and an output terminal of the thirteen controllable switch is connected to the input terminal of the tenth controllable switch and the output terminal of the fifth controllable switch.

8. The scanning-driving circuit according to claim 7, wherein the first to thirteen controllable switches are PMOS thin film transistors or NMOS thin film transistors.

9. The scanning-driving circuit according to claim 4, wherein the pull-up auxiliary module comprises a twelfth controllable switch; a control terminal of the twelfth controllable switch is connected to the output terminal of the first controllable switch; an input terminal of the twelfth controllable switch is connected to the turn-on voltage terminal; and an output terminal of the twelfth controllable switch is connected to the control terminal of the sixth controllable switch.

10. A liquid crystal display device, wherein the liquid crystal display device comprises a scanning-driving circuit and the scanning-driving circuit comprises:

a forward-backward scanning module to output a forward scanning-driving signal and a backward scanning-driving signal to drive the scanning-driving circuit;

a pull-up holding module connected to the forward-backward scanning module to receive a selecting signal outputted from the forward-backward scanning module and to pull up a voltage level of a pull-down control signal node according to the received selecting signal;

an input module connected to the forward-backward scanning module and the pull-up holding module to receive a previous-stage clock signal and to charge a pull-up control signal node according to the received previous-stage clock signal;

a control module connected to the pull-up holding module to receive a present-stage clock signal and to control the pull-up holding module according the received the present-stage clock signal;

an output module connected to the pull-up holding module and the control module to output a scanning-driving signal to a scanning line; and the scanning line transmitting the scanning-driving signal to a pixel unit;

wherein the scanning-driving circuit further comprises a pull-up auxiliary module to prevent the input module from leaking electricity during charging the pull-up control signal node of the output module.

11. The liquid crystal display device according to claim 10, wherein the forward-backward scanning module comprises a first controllable switch, a second controllable switch, a third controllable switch and a fourth controllable switch; a control terminal of the first controllable switch is connected to a first scanning-controlling voltage; an input terminal of the first controllable switch is connected to a next-stage scanning signal; an output terminal of the first controllable switch is connected to the input module and pull-up holding module; a control terminal of the second controllable switch is connected to a second scanning-controlling voltage; an input terminal of the second controllable switch is connected to a previous-stage scanning signal; an output terminal of the second controllable switch is connected to the output terminal of the first controllable switch; a control terminal of the third controllable switch is connected to the first scanning-controlling voltage; an input terminal of the third controllable switch is connected to a third next-stage clock signal; an output terminal of the third controllable switch is connected to the pull-up holding module; a control terminal of the fourth controllable switch is connected to the second scanning-controlling voltage; an input terminal of the fourth controllable switch is connected to a first next-stage clock signal; and an output terminal of the fourth controllable switch is connected to the output terminal of the third controllable switch.

12. The liquid crystal display device according to claim 11, wherein the input module comprises a fifth controllable switch; a control terminal of the fifth controllable switch is connected to a second next-stage clock signal; an input terminal of the fifth controllable switch is connected to the output terminal of the first controllable switch, and an output terminal of the fifth controllable switch is connected to the pull-up holding module and the control module.

13. The liquid crystal display device according to claim 12, wherein the pull-up holding module comprises a sixth controllable switch, a seventh controllable switch, an eighth controllable switch, a ninth controllable switch and a first capacitor; an output terminal of the sixth controllable switch is connected to the output terminal of the fifth controllable switch; a control terminal of the sixth controllable switch is connected to a control terminal of the ninth controllable switch; an input terminals of the sixth, seventh and ninth controllable switches are connected to a turn-on voltage terminal; a control terminal of the seventh controllable switch is connected to the control module, an output terminal of the seventh controllable switch is connected to the control terminals of the sixth and ninth controllable switches; an output terminal of the ninth controllable switch is connected to a scanning line and the output module; one terminal of the first capacitor is connected to the input terminal of the ninth controllable switch; the other terminal of the first capacitor is connected to the control terminal of the ninth controllable switch; a control terminal of the eighth controllable switch is connected to the output terminal of the third controllable switch, an input terminal of the eighth controllable switch is connected to a turn-off voltage terminal; and an output terminal of the eighth controllable switch is connected to the output terminal of the seventh controllable switch.

14. The liquid crystal display device according to claim 13, wherein the scanning-driving circuit further comprises a voltage regulation module to stabilize voltage and to prevent the pull-up holding module from leaking electricity; the voltage regulation module comprises a tenth controllable switch; a control terminal of the tenth controllable switch is connected to the input terminal of the eighth controllable switch and the turn-off voltage terminal; an input terminal of the tenth controllable switch is connected to the input terminal of the fifth controllable switch and the control module; and an output terminal of the tenth controllable switch is connected to the output module.

15. The liquid crystal display device according to claim 14, wherein the output module comprises a eleventh controllable switch and a second capacitor; a control terminal of the eleventh controllable switch is connected to the output terminal of the tenth controllable switch; an input terminal of the seventh controllable switch is connected to a present-stage clock signal; an output terminal of the seventh controllable switch is connected to the output terminal of the ninth controllable switch and the scanning line; one terminal of the second capacitor is connected to the control terminal of the eleventh controllable switch; and the other terminal of the second capacitor is connected to the output terminal of the eleventh controllable switch.

16. The liquid crystal display device according to claim 15, wherein the control module comprises a thirteen controllable switch; a control terminal of the thirteen controllable switch is connected to the present-stage clock signal and the input terminal of the eleventh controllable switch; an input terminal of the thirteen controllable switch is connected to the control terminal of the seventh controllable switch; and an output terminal of the thirteen controllable switch is connected to the input terminal of the tenth controllable switch and the output terminal of the fifth controllable switch.

17. The liquid crystal display device according to claim 16, wherein the first to thirteen controllable switches are PMOS thin film transistors or NMOS thin film transistors.

18. The liquid crystal display device according to claim 13, wherein the pull-up auxiliary module comprises a twelfth controllable switch; a control terminal of the twelfth controllable switch is connected to the output terminal of the first controllable switch; an input terminal of the twelfth controllable switch is connected to the turn-on voltage terminal; and an output terminal of the twelfth controllable switch is connected to the control terminal of the sixth controllable switch.

* * * * *